US007831193B2

(12) United States Patent
Minakuchi

(10) Patent No.: US 7,831,193 B2
(45) Date of Patent: Nov. 9, 2010

(54) IMAGE FORMING DEVICE

(75) Inventor: Koji Minakuchi, Chuo-ku (JP)

(73) Assignee: Kyocera Mita Corporation, Osaka (JP)

( * ) Notice: Subject to any disclaimer, the term of this patent is extended or adjusted under 35 U.S.C. 154(b) by 415 days.

(21) Appl. No.: 12/077,704

(22) Filed: Mar. 20, 2008

(65) Prior Publication Data

US 2008/0240782 A1 Oct. 2, 2008

(30) Foreign Application Priority Data

Mar. 27, 2007 (JP) ..... 2007-082165

(51) Int. Cl.
*G03G 15/00* (2006.01)

(52) U.S. Cl. ..... 399/391; 399/23

(58) Field of Classification Search ..... 399/23, 399/45, 43, 388, 389, 391
See application file for complete search history.

(56) References Cited

U.S. PATENT DOCUMENTS 5,420,669 A * 5/1995 Imada ..... 399/45
6,963,721 B2 * 11/2005 Asai et al. ..... 399/391
2002/0024575 A1 * 2/2002 Sato
2002/0051192 A1 * 5/2002 Utsunomiya

FOREIGN PATENT DOCUMENTS

JP 05281806 A * 10/1993
JP 05309891 A * 11/1993
JP 2005-082319 3/2005

* cited by examiner

*Primary Examiner*—Susan S Lee
(74) *Attorney, Agent, or Firm*—Jordan and Hamburg LLP

(57) ABSTRACT

Provided is an image forming device including: a sheet number control part for controlling a maximum processable sheet number set on a paper attribute basis for a finisher for finishing a printed sheet; an automatic tray switching part for switching an initially selected tray part to another tray part when paper runs out in the midst of print processing on sheets fed from the initially selected tray part to continue the print processing, the initially selected tray part being initially selected from a plurality of tray parts holding sheets of different paper attributes; and a tray switch determining part for, when a feeding tray part runs out of paper in the midst of print processing set to execute finishing, determining whether to actuate the automatic tray switching part on the basis of maximum processable sheet numbers and a paper attribute of paper of a selectable tray part candidate.

10 Claims, 6 Drawing Sheets

| Paper type | Maximum finishable sheet number |
|---|---|
| Plain paper | 30 |
| Recycled paper | 30 |
| High quality paper | 20 |
| Color paper | 20 |
| OHP | Stapling unavailable Punching 15 |

Fig.3A

| Current tray | Held paper type | Paper size |
|---|---|---|
| First tray | Plain paper | A4 |
| Second tray | High quality paper | A4 |
| Third tray | Plain paper | A3 |
| Fourth tray | Color paper | B4 |

Fig.3B

The current tray has run out of paper

Reload paper

OK

Stop printing

Fig.3C

IMAGE FORMING DEVICE

This application is based on an application No. 2007-082165 filed in Japan, the contents of which are hereby incorporated by reference.

BACKGROUND OF THE INVENTION

1. Field of the Invention

The present invention relates to an image forming device including: a sheet number control part for controlling a maximum processable sheet number that is set on a paper attribute basis for a finishing device (hereinafter referred to as finisher) such as a stapler and a puncher (punch mechanism); and an automatic tray switching part for, when, in the midst of print processing, paper runs out from a tray part that is initially selected from a plurality of tray parts each holding sheets of different paper attributes, switching the tray part to another tray part to continue the print processing.

2. Description of the Related Art

Conventionally, image forming devices are provided with automatic tray switching parts (hereinafter occasionally referred to as ATS (Automatic Tray Switch)) for, when, in the midst of print processing, paper feeding becomes unavailable from a tray due to an out-of-paper or other situation, automatically switching the tray to another tray that holds paper of the same size to continue the print processing.

For example, in Japanese Unexamined Patent Publication No. 2005-82319, there is proposed an image forming device including an ATS that has set therein switching conditions for trays on a paper type basis such as plain paper and reused paper printed on one side, and that is for, when, in the midst of print processing, paper feeding is unavailable from a tray because it has run out of paper, switching paper feeding from the tray to another tray that holds paper of the type for which switching is permitted in advance, to continue the printing.

The technique described in the 2005-82319 publication enables printing to continue while eliminating sheet combinations not intended by the user such as inclusion of one-sided paper in plain paper in the midst of printing on plain paper, and enables paper feeding that satisfies various demands by users without-lowering working efficiency.

Incidentally, a finisher for carrying out processing such as stapling and punching on sheets output from the image forming device has a maximum processable sheet number that is set in advance according to paper attribute information denoting the thicknesses of sheets. This is because the number of sheets on which the finisher can operate properly is limited by the thicknesses of sheets.

In the image forming device provided with such a finisher, when, in the midst of an image forming operation involving finishing, the ATS function operates to select sheets of different thickness from that of the previous sheets, then a maximum finishable sheet number for the selected sheets is changed to a maximum finishable sheet number corresponding to thick paper, which provides restricting conditions, or maintained at a maximum finishable sheet number corresponding to the previous sheets.

Specifically, an image forming device will be exemplified where two different trays hold same size sheets while the "paper type" is "plain paper" in one tray and "high quality paper" in the other tray, and where a maximum processable sheet number of 30 for "plain paper" and a maximum processable sheet number of 20 for "high quality paper" are set for the stapler.

For example, assume that in the midst of print processing that is set to execute printing on "plain paper" to an output sheet number of 25, the tray holding "plain paper" runs out of paper after having fed 15 sheets, and the ATS causes the sixteenth and other sheets to be fed from the tray holding "high quality paper." In this case, when the total number of printed sheets reaches 20, which is the maximum processable sheet number corresponding to "high quality paper," then stapling is determined to be unavailable and the print processing is suspended.

In this case of inconvenient situation where the printing operation is suspended before completion of printing of the set 25 sheets, the significance of the automatic tray switching part, which is intended to improve working efficiency, is lost.

Even though the print processing is continued by reloading the tray with "plain paper," an unnatural situation results where the printed sheets are a mixture of "plain paper " and "high quality paper," which necessitates printing again on "plain paper," resulting in a waste of output sheets of "high quality paper."

SUMMARY OF THE INVENTION

In view of the foregoing problems, an object of the present invention is to provide an image forming device that is capable of lowering material cost by preventing wasteful printing by restricting the operation of the automatic tray switching part during print processing involving finishing.

In order to achieve the foregoing object, an image forming device of the present invention includes: a sheet number control part for controlling a maximum processable sheet number set on a paper attribute basis for a finisher for finishing a printed sheet; and an automatic tray switching part for switching an initially selected tray part to another tray part when the initially selected tray part runs out of paper in the midst of print processing on sheets fed from the initially selected tray part, the initially selected tray part being initially selected from a plurality of tray parts holding sheets of different paper attributes. The image forming device includes a tray switch determining part for, when a selected tray part runs out of paper in the midst of print processing set to execute finishing, determining whether to actuate the automatic tray switching part on the basis of maximum processable sheet numbers and a paper attribute of paper of a tray part candidate selectable by the automatic tray switching part.

Further, other aspects of the present invention will become clear by referring to embodiments provided hereinafter.

BRIEF DESCRIPTION OF THE DRAWINGS

FIG. 3A is table data showing the relation between paper type and the finishable sheet number;

FIG. 3B is memory data showing paper type and paper size of sheets held in the trays of the copier;

FIG. 3C is an alarming display showing that a currently feeding tray has run out of paper;

DESCRIPTION OF THE PREFERRED EMBODIMENTS

Hereinafter description will be made of a copier of an electrophotographic system, which is an example of the image forming device of the present invention.

Figure 2:
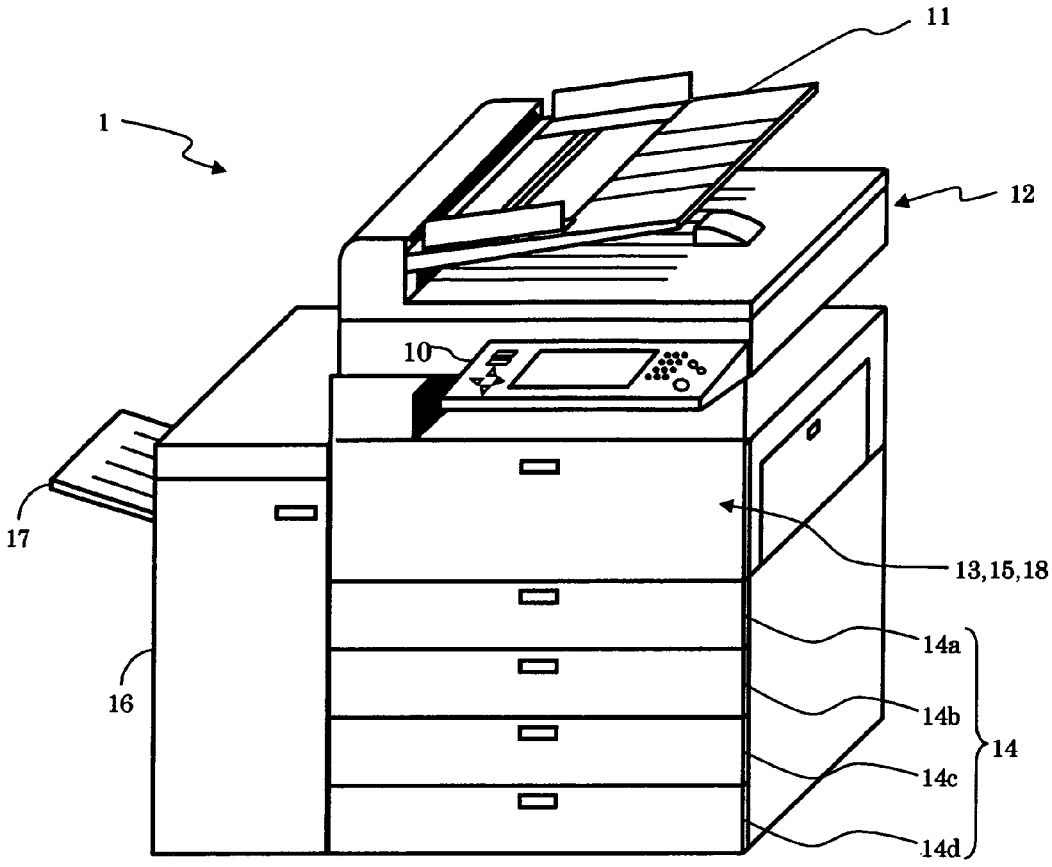
FIG. 2 is a diagram illustrating the copier.

As shown in FIG. 2, a copier 1 of the present invention includes an operation part 10 having a screen part provided with a liquid crystal screen of a touch panel system and an input part provided with hardware keys, a document feeding part 11 on which to set originals, an image reading part 12, an image processing part 13, an image outputting part 15, trays 14 to serve as tray parts, a finisher 16 and the like.

The image reading part 12 sequentially reads, via CCD, a series of originals set on the document feeding part 11 to form photoelectrically converted image data. The image processing part 13 carries out predetermined image processing on the image data formed at the image reading part 12.

The image outputting part 15 forms a toner image onto a photoreceptor on the basis of the image data image-processed at the image processing part 13, and transcribes and fixes the toner image onto a sheet conveyed from any one of the plurality of trays 14 (14*a* to 14*d*) stacked atop each other.

The finisher 16 carries out finishing such as stapling on the sheet output from the image outputting part 15 and outputs the sheet on the output tray 17.

Figure 1:
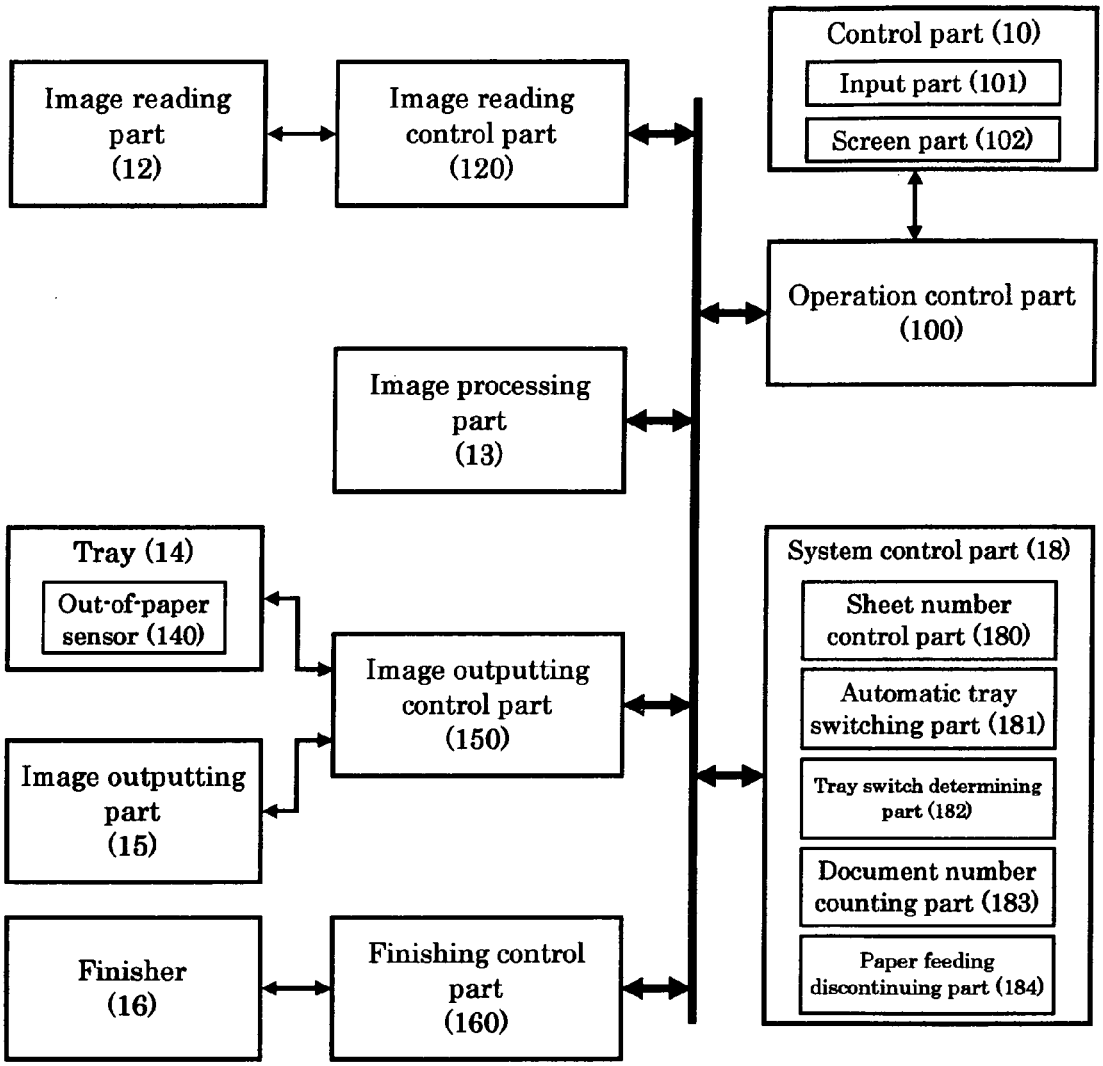
FIG. 1 is a block diagram illustrating a main configuration of a copier related to the present invention.

As shown in FIG. 1, the copier 1 includes an operation control part 100 for controlling the operation part 10, an image reading control part 120 for controlling the image reading part 12, an image outputting control part 150 for controlling the trays 14 and the image outputting part 15, and a finishing control part 160 for controlling the finisher 16, the control parts being connected to, via a bus, a system control part 18 for integrally controlling the image forming system.

Each of the control parts is constituted by having a CPU, a ROM storing a control program executed by the CPU, a RAM to serve as a working area, and the like. Control data, image data, and the like formed by the control parts are transmitted and received via the bus.

The operation control part 100 outputs to the system control part 18 operation input information input by an operator via an input part 101, such as the touch panel and the hardware keys, and shows on a screen part 102 a corresponding display on the basis of a display instruction from the system control part 18.

The image reading control part 120 controls a document conveying mechanism, a light source, CCD, and the like to form image data corresponding to the series of originals set on the document feeding part 11.

The image processing part 13 subjects the image data read by the image reading part 12 to gradation correction, color correction, size enlargement or reduction, and the like to form output image data.

The image outputting control part 150 controls a photoreceptor unit and a developing unit to form a toner image based on the output image data, transcribes the toner image onto a sheet conveyed from one of the trays 14 through a sheet conveying mechanism, and subjects the sheet with the transcribed toner image to fixing processing with a fixer.

Further, the image outputting control part 150 receives an out-of-paper detection signal from an out-of-paper sensor 140 provided on each of the trays 14, and outputs to the system control part 18 information on the tray 14 that has run out of paper.

The finishing control part 160 controls a stapler and a puncher incorporated in the finisher 16, and on the basis of a finishing mode set by the operator, carries out finishing such as stapling and punching on the sheet output from the image outputting part 15, and outputs the sheet on the output tray 17.

A CPU constituting the system control part 18, control programs executed by the CPU, and periphery circuits constitute a plurality of functional blocks for controlling the copying system. Among the blocks, functional blocks according to the present invention are established including, as shown in FIG. 1, a sheet number control part 180, an automatic tray switching part 181, a tray switch determining part 182, a document number counting part 183, and a paper feeding discontinuing part 184.

The functional blocks will be described in order below.

The sheet number control part 180 controls a maximum processable sheet number set on a paper attribute basis for the finisher 16, and controls, as shown in FIG. 3A, table data that specifies paper types as paper attributes denoting paper thicknesses and maximum finishable sheet numbers corresponding to the paper types. The table data is stored in advance on the RAM or the ROM of the system control part 18.

While the table data shows the paper attribute by "paper type" such as "plain paper," "recycled paper," "high quality paper," and "color paper," the paper attribute may be constituted by information by which paper thickness can be identified, such as weight per unit area (g/m$^2$).

Figure 4:
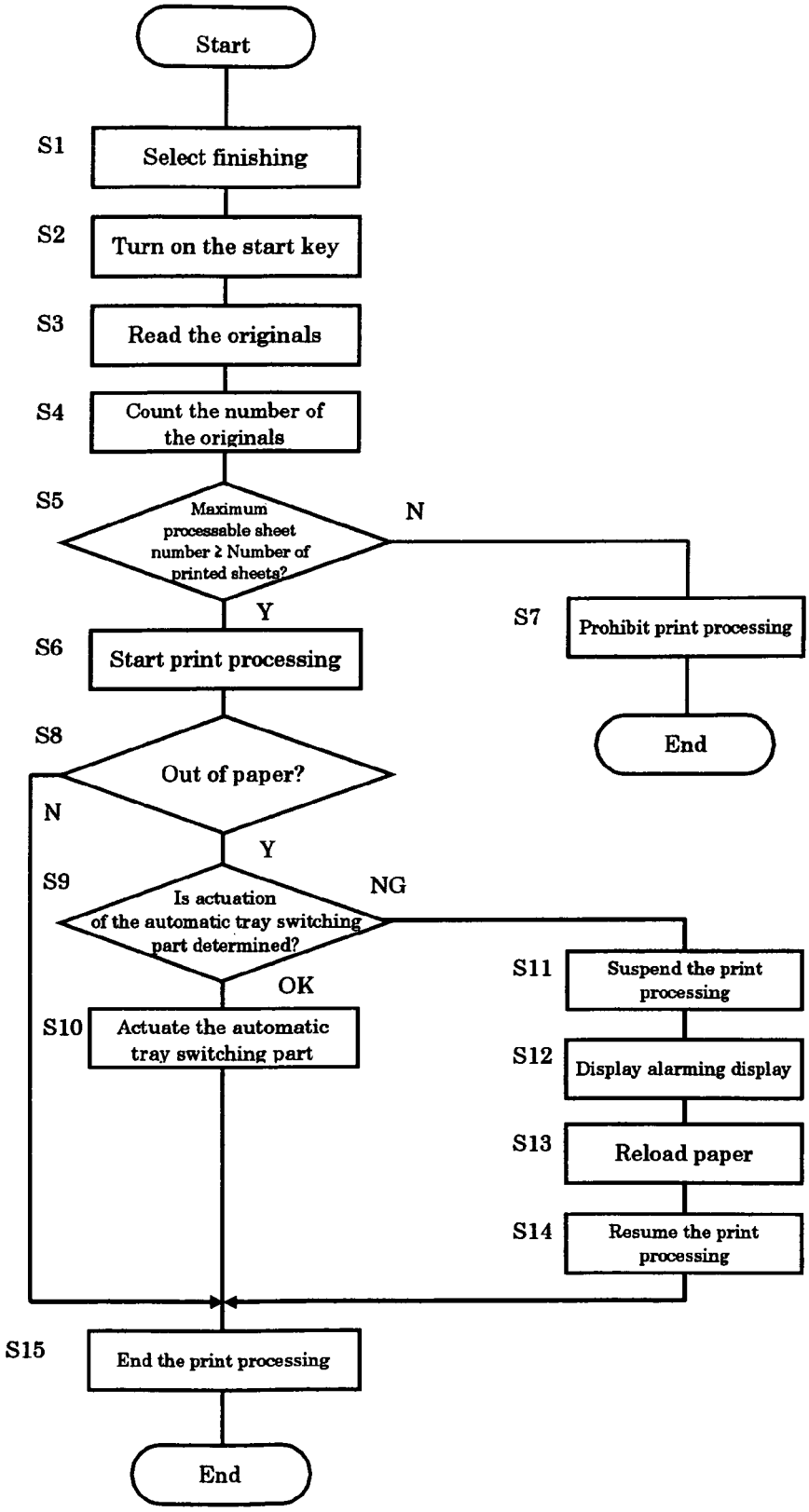
FIG. 4 is a flowchart describing a switching operation of the tray part in relation to a memory accumulation print system.

As shown in FIG. 4, when the operator selects, via the operation part 10, print processing involving finishing by the finisher 16 (S1) and operates the start key (S2), then the system control part 18 starts the reading operation of a series of originals via the image reading control part 120 (S3).

Image data formed at the image reading part 12 is stored in a memory, and the document number counting part 183 counts the number of the originals (S4).

The sheet number control part 180 reads from its table data a maximum processable sheet number corresponding to sheets held in an initially selected tray 14, and compares the maximum processable sheet number with the number of printed sheets calculated on the basis of the number of the originals (S5).

As a result of the comparison, when the number of the printed sheets is smaller than the maximum processable sheet number, the system control part 18 starts the print processing via the image outputting control part 150 (S6), and hereinafter the sheet number control part 180 controls the maximum processable sheet number corresponding to the sheets held in the initially selected tray 14 as the maximum processable sheet number in the print processing.

On the other hand, when the number of the printed sheets is larger than the maximum processable sheet number, the system control part 18 prohibits the printing while displaying, via the operation control part 100, an alarming message such as "print unavailable. The number of the maximum processable sheets is exceeded." on the screen part (S7).

When the tray 14 initially selected from the plurality of trays 14 holding sheets of different paper attributes runs out of paper in the midst of the print processing, then the automatic tray switching part 181 reads, from the RAM, information on the paper types and paper sizes of the paper held in the trays 14 (14*a* to 14*d*) shown in FIG. 3B, and executes the ATS function to continue the print processing by switching to another tray 14 that holds paper of the same size as that of the paper of the initially selected tray 14.

When the paper of the initially selected tray 14 is one of "plain paper," "recycled paper," and "high quality paper," then the automatic tray switching part 181 selects another tray 14 that holds paper of the same size and paper attribute as those of the paper of the initially selected tray 14. When no other trays 14 hold paper of the same paper attribute as that of the paper of the initially selected tray 14, the automatic tray switching part 181 selects another tray 14 that holds paper which is the same size as that of the paper of the initially selected tray 14 and which is one of "plain paper," "recycled paper," and "high quality paper." When the paper of the initially selected tray 14 is "color paper," the automatic tray switching part 181 selects another tray 14 that holds paper which is the same size as that of the paper of the initially selected tray 14 and which is "color paper" of the same color of the color of the paper of the initially selected tray 14.

The information on paper type and paper size is set and input by the operator via the operation part 10 or obtained by reading values indicated on the size sensor and type sensor provided on the tray.

For example, when print processing not involving finishing by the finisher 16 is selected, the system control part 18 controls the image outputting control part 150 so that paper feeding is continued from the tray newly selected by the automatic tray switching part 181, thereby continuing the print processing.

When the initially selected tray 14 runs out of paper in the midst of the print processing while no other trays 14 hold the same size paper, the system control part 18 does not actuate the automatic tray switching part 181 and suspends the print processing.

Here the system control part 18 displays, via the operation control part 100, an alarming display on the screen part 102 as shown in FIG. 3C, and resumes the print processing upon reloading of the tray with paper by the operator in response to the display.

For example, assume that the first tray 14*a* holds plain paper of A4 size, the second tray 14*b* holds high quality paper of A4 size, the third tray 14*c* holds plain paper of A3 size, and the fourth tray 14*d* holds color paper of B4 size. When, in the midst of print processing that initially selects the first tray 14*a*, the first tray 14*a* runs out of paper, then the automatic tray switching part 181 switches the tray to the second tray 14*b*.

However, when, in the midst of print processing that initially selects the third tray 14*c*, the third tray 14*c* runs out of paper, then the automatic switching of trays is not carried out, since no other trays hold the same size paper.

Next, the operation of the automatic tray switching part 181 in relation to print processing involving finishing by the finisher 16 will be described in detail.

When an initially selected tray 14 runs out of paper in the midst of print processing involving finishing by the finisher 16 (S8), the tray switch determining part 182 determines whether to actuate the automatic tray switching part 181 on the basis of maximum processable sheet numbers (see FIG. 3A) controlled by the sheet number control part 180 and the paper attribute (see FIG. 3B) of a tray candidate selectable by the automatic tray switching part 181 (S9).

When the number of printed sheets calculated on the basis of the number of the originals counted by the document number counting part 183 exceeds a maximum processable sheet number corresponding to the paper attribute of the paper of the selectable tray candidate even though the number of the printed sheets is smaller than a corresponding maximum processable sheet number controlled by the sheet number control part 180, then the tray switch determining part 182 prohibits actuation of the automatic tray switching part 181.

As a result, the system control part 18 suspends the printing (S11) and displays an alarming display as shown in FIG. 3C (S12). Upon reloading of paper by the operator (S13), the print processing resumes (S14).

On the other hand, when the number of printed sheets calculated on the basis of the number of the originals counted by the document number counting part 183 is smaller than the corresponding maximum processable sheet number controlled by the sheet number control part 180 while at the same time not exceeding the maximum processable sheet number corresponding to the paper attribute of the paper of the selectable tray candidate, then the tray switch determining part 182 permits actuation of the automatic tray switching part 181 (S10), and the print processing ends (S15).

This precludes inconvenient occurrences including, as a result of continuation of print processing by actuating the automatic tray switching part 181, discontinuation of the print processing in the midst thereof upon reaching of the number of the printed sheets to the maximum processable sheet number.

As used herein, the number of printed sheets calculated on the basis of the number of originals is the number of printed sheets required in a simplex print mode. However, in a duplex print mode of one-sided originals and in a compact print mode where two sheets of originals are reduced and printed onto one side of a sheet, the number of printed sheets is ½ of the one in the simplex print mode, and a combination of the duplex print mode and the compact print mode makes the number of printed sheets ¼ of the one in the simplex print mode. Thus, the number of printed sheets cannot be calculated from the number of originals alone.

In view of this, in print processing where the number of originals and the number of printed sheets differ, the number of printed sheets is preferably calculated on the basis of the number of originals and the print mode. The print mode, on which calculation of the number of printed sheets is based, includes one-sided originals/simplex printing with or without compact printing, one-sided originals/duplex printing with or without compact printing, two-sided originals/simplex printing with or without compact printing, and two-sided originals/duplex printing with or without compact printing, and a combination of the foregoing.

In this case, the tray switch determining part 182 can prohibit actuation of the automatic tray switching part 181 when the number of printed sheets calculated on the basis of the number of originals and the print mode exceeds the maximum processable sheet number that is based on the paper attribute of the paper of the selectable tray candidate. This applies to the embodiments that follow.

In the above-described embodiment, the number of printed sheets needs to be in grasp at the time when the tray switch determining part 182 determines whether to permit or prohibit actuation of the automatic tray switching part 181. This finds applications in memory accumulation print systems that cause all the originals to be read at the image reading part 12 and carries out sequential print processing on the basis of image data stored in a memory.

However, in the case of employing what is called a parallel print system, which carries out printing simultaneously with sequentially reading the originals at the image reading part 12 in an attempt to shorten the first copying time, when the tray runs out of paper in the midst of print processing, not all the originals may be in grasp at the time when paper runs out.

In this case, the tray switch determining part 182 cannot properly determine whether to permit or prohibit actuation of the automatic tray switching part 181.

In case of such a situation, the document number counting part 183 counts, as the number of the originals, the number of image data formed from the originals read by the image reading part 12. The number of the originals thus counted by the document number counting part 183 is used by the tray switch determining part 182 in determining whether to actuate the automatic tray switching part 181.

In a first parallel print system, when a selected tray 14 runs out of paper in the midst of print processing involving finishing by the finisher 16, the tray switch determining part 182 prohibits actuation of the automatic tray switching part 181 until all the originals are counted by the document number counting part 183.

When the tray 14 holds an enough number of sheets, the system control part suspends the print processing upon exceeding of the number of the printed sheets over the maximum processable sheet number corresponding to the paper attribute of the sheets.

Figure 5:
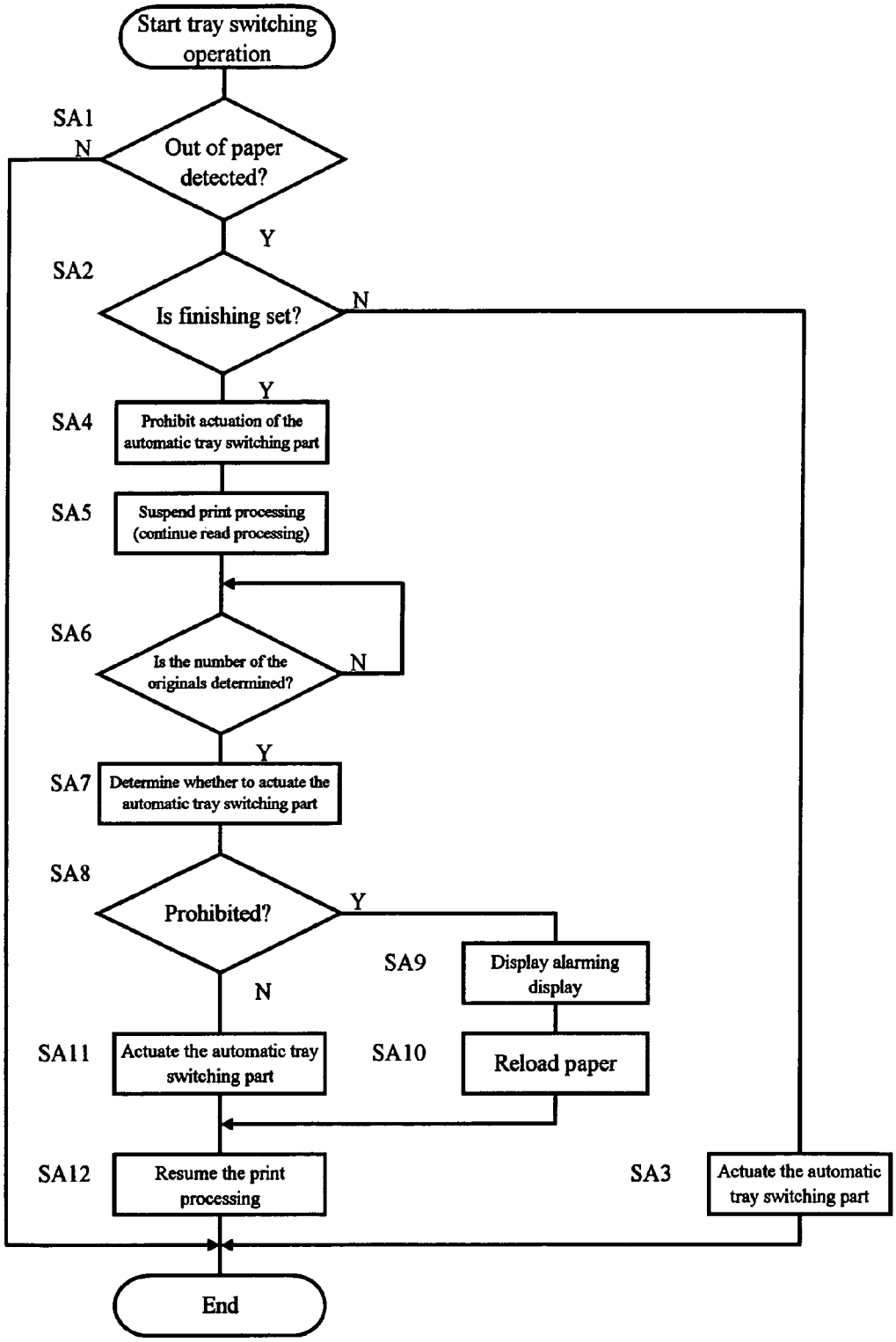
FIG. 5 is a flowchart describing a switching operation of the tray part in relation to a first parallel print system.

The tray switching operation of the copier 1 in this situation will be described below by referring to the flowchart shown in FIG. 5.

In the event that an initially selected tray runs out of paper in the midst of print processing (SA1), when the print processing does not incorporate finishing by the finisher (SA2), then the automatic tray switching part 181 is actuated to continue the print processing (SA3).

When the print processing incorporates finishing by the finisher (SA2), the tray switch determining part 182 prohibits actuation of the automatic tray switching part 181 (SA4) to temporarily suspend the print processing while continuing read processing of the originals (SA5). Here image data formed at the image reading part 12 is stored in a memory, and the document number counting part 183 counts the number of the originals.

At this time, the print system is changed from the parallel print system to the memory accumulation print system.

When the image reading part 12 reads all the originals to determine the number of the originals to be counted by the document number counting part 183 (SA6), the tray switch determining part 182 determines whether to actuate the automatic tray switching part 181 on the basis of: whether the number of printed sheets calculated on the basis of the number of the originals counted by the document number counting part 183 is smaller than a corresponding maximum processable sheet number controlled by the sheet number control part 180; and whether the number of the printed sheets exceeds a maximum processable sheet number corresponding to the paper attribute of the paper of a selectable tray candidate (SA7).

When the tray switch determining part 182 prohibits actuation of the automatic tray switching part 181 (SA8), the screen part 102 displays an alarming display (SA9). When, in response, the operator reloads the out-of-paper tray with paper (SA10), the print processing resumes (SA12).

When the tray switch determining part 182 permits actuation of the automatic tray switching part 181 (SA8), the automatic tray switching part 181 selects a selectable tray candidate (SA11), and the print processing that was suspended in step SA5 resumes (SA12).

Description will be made below of a second parallel print system that maintains the parallel print system even when a selected tray 14 runs out of paper in the midst of print processing involving finishing by the finisher 16.

When the tray 14 runs out of paper, the tray switch determining part 182 permits actuation of the automatic tray switching part 181 when the number of printed sheets calculated on the basis of the number of originals counted so far by the document number counting part 183 is smaller than a corresponding maximum processable sheet number controlled by the sheet number control part 180 while at the same time not exceeding a maximum processable sheet number corresponding to the paper attribute of the paper of a selectable tray candidate.

When, after the permission, the number of the printed sheets calculated on the basis of the number of the originals counted by the document number counting part 183 exceeds the smaller one of the maximum processable sheet numbers, then the paper feeding discontinuing part 184 forcibly discontinues paper feeding from the newly switched tray 14.

Also in this case, when the tray 14 holds an enough number of sheets, the system control part 18 suspends the print processing upon exceeding of the number of the printed sheets over the maximum processable sheet number corresponding to the paper attribute of the sheets.

Figure 6:
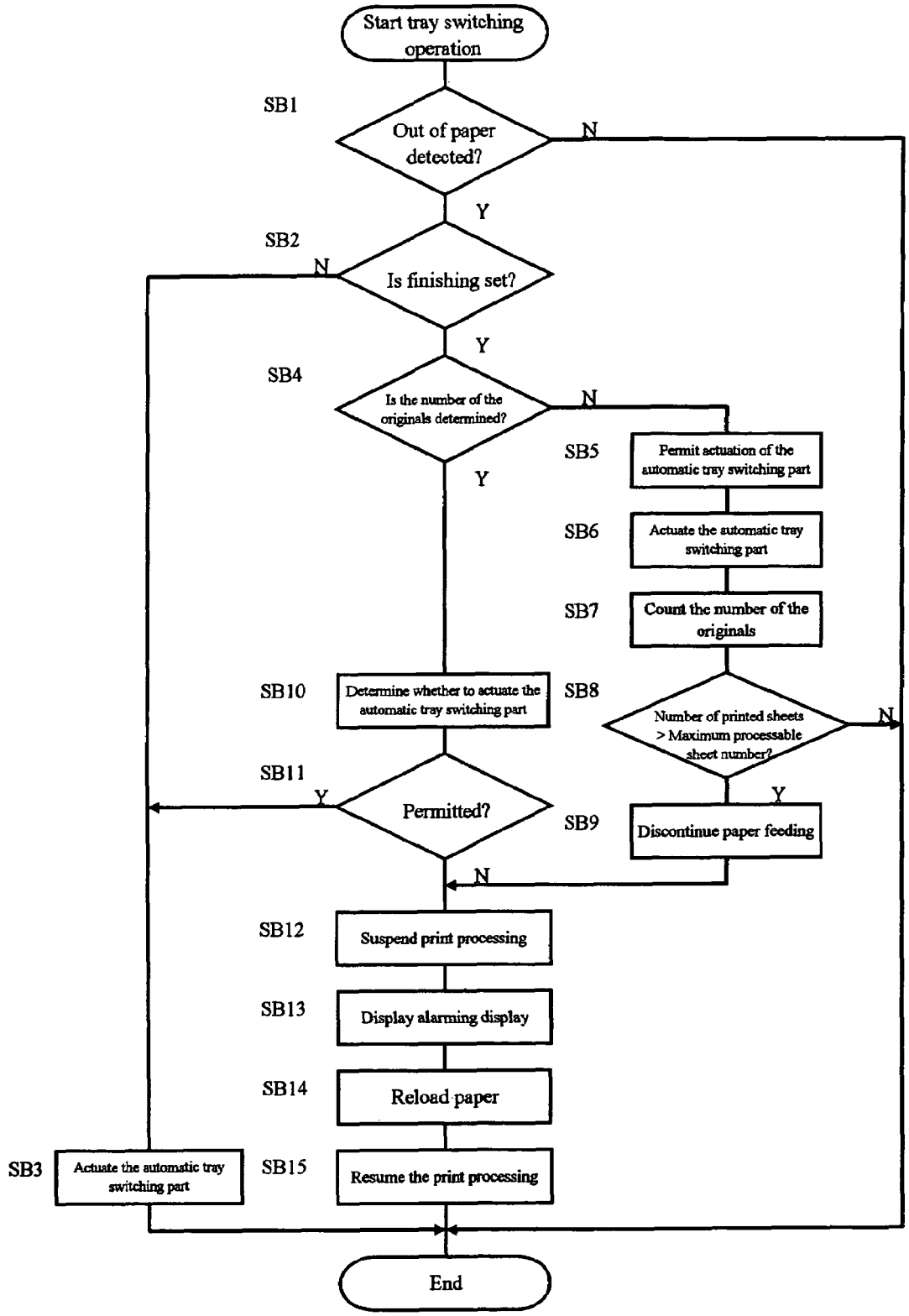
FIG. 6 is a flowchart describing a switching operation of the tray part in relation to a second parallel print system.

The tray switching operation of the copier 1 in this situation will be described below by referring to the flowchart shown in FIG. 6.

In the event that an initially selected tray runs out of paper in the midst of print processing (SB1), when the print processing does not have set therein finishing by the finisher (SB2), then the automatic tray switching part 181 is actuated (SB3) to continue the print processing.

When the print processing incorporates finishing by the finisher (SB2), and the number of originals to be counted by the document number counting part 183 is not determined yet (SB4), then the tray switch determining part 182 permits actuation of the automatic tray switching part 181 (SB5), and thus the automatic tray switching part 181 is actuated to continue the print processing (SB6). This is for the purpose of continuing the print processing as long as possible.

When the document number counting part 183 continues counting the number of originals (SB7), and the number of the printed sheets is smaller than the smaller one of maximum processable sheet numbers corresponding to the paper attributes of the paper of the initially selected tray 14 and a selectable tray candidate 14 (SB8), then the print processing continues. When the number of the printed sheets exceeds the smaller maximum processable sheet number (SB8), the paper feeding discontinuing part 184 forcibly discontinues paper feeding (SB9) to suspend the print processing (SB12).

When, in step SB4, the number of originals to be counted by the document number counting part 183 is determined, the tray switch determining part 182 determines whether to actuate the automatic tray switching part 181 on the basis of whether the number of the printed sheets calculated on the basis of the number of the originals is less than the smaller one of the maximum processable sheet numbers corresponding to the paper attributes of the paper of the initially selected tray 14 and the selectable tray candidate 14 (SB10).

When the number of the printed sheets is smaller than the smaller maximum processable sheet number, the tray switch determining part 182 actuates the automatic tray switching part 181 (SB11, SB3) to continue the print processing.

When the number of the printed sheets is equal to or more than the smaller maximum processable sheet number, the tray switch determining part 182 prohibits actuation of the automatic tray switching part 181 (SB11) to suspend the print processing (SB12).

After step SB12, when the screen part 102 displays an alarming display (SB13) and the operator reloads the out-of-paper tray with paper (SB14), and the print processing resumes (SB15).

Other embodiments will be described below.

While the above-described embodiment describes the case where the maximum processable sheet number compared with the number of printed sheets by the tray switch determining part or the paper feeding discontinuing part is a value corresponding to the paper attribute of the paper held in the selectable tray candidate, the maximum processable sheet number may be set as a variable value that is based on the number of sheets fed from the initially selected tray and the selectable tray candidate.

For example, when "plain paper" and "high quality paper" are used as printed sheets, the maximum processable sheet number may be a value obtained by adding the number of fed sheets of "plain paper" and the number of feedable sheets of "high quality paper" obtained by a ratio between the maximum processable sheet number corresponding to "plain paper" and the maximum processable sheet number corresponding to "high quality paper."

As a specific example, assume that when the maximum processable sheet number of "plain paper" is set at 30 and the maximum processable sheet number of "high quality paper" is set at 20, then "high quality paper" is counted as 1.5 sheet per 1 sheet of "plain paper." When the number of sheets of "plain paper" fed from the initially selected tray is 10, the number of feedable sheets of "high quality paper" from the selectable tray candidate is calculated by (20−10)/1.5.

The above embodiments have been described by way of example and will not limit the present invention; it will be appreciated that various modifications can be made to the specific details of the constituent parts of the present invention without departing from the scope of the present invention.

What is claimed is:

1. An image forming device provided with a finisher, the image forming device comprising:

a sheet number control part for controlling a maximum processable sheet number set on a paper attribute basis for the finisher;

an automatic tray switching part for, when an initially selected tray part runs out of paper in the midst of print processing, switching the initially selected tray part to another tray part holding paper of the same size as the size of paper of the initially selected tray part; and a tray switch determining part for, when a selected tray part runs out of paper in the midst of print processing incorporating finishing by the finisher, determining whether to actuate the automatic tray switching part on the basis of maximum processable sheet numbers and a paper attribute of paper of a tray part candidate selectable by the automatic tray switching part.

2. The image forming device according to claim 1, wherein when a number of printed sheets calculated on the basis of a number of originals exceeds a maximum processable sheet number that is based on the paper attribute of the paper of the selectable candidate, the tray switch determining part prohibits actuation of the automatic tray switching part.

3. The image forming device according to claim 1, wherein when a number of printed sheets calculated on the basis of a number of originals and a print mode exceeds a maximum processable sheet number that is based on the paper attribute of the paper of the selectable candidate, the tray switch determining part prohibits actuation of the automatic tray switching part.

4. The image forming device according to claim 1, further comprising a document number counting part for counting a number of originals to be printed, wherein the tray switch determining part prohibits actuation of the automatic tray switching part until the number of the originals counted by the document number counting part is determined.

5. The image forming device according to claim 1, further comprising a document number counting part for counting a number of originals to be printed, wherein:

when a number of printed sheets calculated on the basis of the number of the originals counted by the document number counting part is smaller than a maximum processable sheet number that is based on the paper attribute of the paper of the selectable candidate, the tray switch determining part permits actuation of the automatic tray switching part; and the image forming device further comprises a paper feeding discontinuing part for discontinuing paper feeding from the selected tray part when, after the permission, the number of the printed sheets calculated on the basis of the number of the originals counted by the document number counting part exceeds the maximum processable sheet number.

6. A method for controlling an image forming device provided with a finisher, the method comprising:

a sheet number control step of controlling a maximum processable sheet number set on a paper attribute basis for the finisher;

an automatic tray switching step of, when an initially selected tray part runs out of paper in the midst of print processing, switching the initially selected tray part to another tray part holding paper of the same size as the size of paper of the initially selected tray part; and a tray switch determining step of, when a selected tray part runs out of paper in the midst of print processing incorporating finishing by the finisher, determining whether to carry out the automatic tray switching step on the basis of maximum processable sheet numbers and a paper attribute of paper of a tray part candidate selectable by the automatic tray switching step.

7. The method according to claim 6, wherein when a number of printed sheets calculated on the basis of a number of originals exceeds a maximum processable sheet number that is based on the paper attribute of the paper of the selectable candidate, the tray switch determining step prohibits actuation of the automatic tray switching step.

8. The method according to claim 6, wherein when a number of printed sheets calculated on the basis of a number of originals and a print mode exceeds a maximum processable sheet number that is based on the paper attribute of the paper of the selectable candidate, the tray switch determining step prohibits actuation of the automatic tray switching step.

9. The method according to claim 6, further comprising a document number counting step of counting a number of originals to be printed, wherein the tray switch determining step prohibits actuation of the automatic tray switching step until the number of the originals counted by the document number counting step is determined.

10. The method according to claim 6, further comprising a document number counting step of counting a number of originals to be printed, wherein:

when a number of printed sheets calculated on the basis of the number of the originals counted in the document number counting step is smaller than a maximum processable sheet number that is based on the paper attribute of the paper of the selectable candidate, the tray switch determining step permits carrying out of the automatic tray switching step; and the method further comprises a paper feeding discontinuing step of discontinuing paper feeding from the selected tray part when, after the permission, the number of the printed sheets calculated on the basis of the number of the originals counted in the document number counting step exceeds the maximum processable sheet number.

* * * * *